US005113925A

United States Patent [19]

Cook

[11] Patent Number: 5,113,925

[45] Date of Patent: May 19, 1992

[54] INVESTMENT CASTING OF METAL MATRIX COMPOSITES

[75] Inventor: Arnold J. Cook, Pittsburgh, Pa.

[73] Assignee: PCast Equipment Corporation, Pittsburgh, Pa.

[21] Appl. No.: 594,303

[22] Filed: Oct. 9, 1990

[51] Int. Cl.[5] ..... B22D 19/14

[52] U.S. Cl. ..... 164/35; 164/97; 164/98

[58] Field of Search ..... 164/34, 35, 36, 97, 164/98, 45, 516

[56] References Cited

U.S. PATENT DOCUMENTS

| | | | |
|---|---|---|---|
| 4,109,699 | 8/1978 | Miller et al. | 164/35 |
| 4,365,997 | 12/1982 | Jachowski et al. | 164/97 |
| 4,476,916 | 10/1984 | Nusbaum | 164/97 |

FOREIGN PATENT DOCUMENTS

| | | | |
|---|---|---|---|
| 58-29564 | 2/1983 | Japan | 164/97 |
| 554930 | 5/1977 | U.S.S.R. | 164/45 |
| 996063 | 2/1983 | U.S.S.R. | 164/97 |

*Primary Examiner*—Kuang Y. Lin
*Attorney, Agent, or Firm*—Ansel M. Schwartz

[57] ABSTRACT

A method for forming a metal matrix composite within a mold of investment material. The method comprises the steps of forming a preform mixture of liquid flow medium, binding agent and reinforcement into the desired shape of a metal matrix composite. Then, allowing the preform mixture to solidify into desired shape. Next, encasing the preform mixture within investment material. Then, heating the preform mixture at a controlled rate which first allows any fluid, such as water, to evaporate, then allows removal of the flow medium. Next, sintering the remaining reinforcement material and binder to form a solid preform. Then, forcing molten metal under pressure into said preform. Next, solidifying the molten metal to form a metal matrix composite in the shape of this preform; and removing the investment material from metal matrix composite. Additionally, there is a method comprising the steps of connecting a preform, which has been previously prepared for infiltration of molten metal, to a sprue system. Next, encasing the preform and sprue system within investment material. Then, melting out the sprue system to form piping which allows the metal to flow to the preform. Next, forcing molten metal under pressure through the sprue system and into the preform. Then, solidifying the molten metal to form a metal matrix composite in the shape of the preform; and removing the investment material from metal matrix composite.

7 Claims, 3 Drawing Sheets

INVESTMENT CASTING OF METAL MATRIX COMPOSITES

FIELD OF THE INVENTION

The present invention is related to an apparatus for casting. More specifically, the present invention is related to a method for casting metal matrix composites within investment material.

BACKGROUND OF THE INVENTION

Investment casting, also known as the lost wax method, is one of the oldest processes for the forming of metal. It was used extensively by the ancient craftsman, to form jewelry and is currently the preferred method for casting complex parts for aircraft engines. Patterns are typically formed by pressure injection of wax or plastic into a precision metal die. Patterns, either singly or in groups, are fitted with wax gates and risers and encased in an investment material such as a slurry of refractory material. The wax or plastic patterns are then melted out of the investment material thereby leaving molds of the parts to be cast connected by a series of gates and risers. The preferred molten metal is then caused to fill the hollow impressions through the piping of the gates and risers. After solidification, the investment material is removed from the metal parts.

In the past, metal matrix composites have been investment casted by first mixing the metal with the reinforcement and then introducing the molten mixture to the mold. There is no known method that allows the infiltration of the reinforcement material within a mold of investment material.

SUMMARY OF THE INVENTION

The present invention pertains to a method for forming a metal matrix composite within a mold of investment material. The method comprises the steps of forming a preform mixture of liquid flow medium, binding agent and reinforcement into the desired shape of a metal matrix composite. Then, allowing the preform mixture to solidify into desired shape. Next, encasing the preform mixture within investment material. Then, heating the preform mixture at a controlled rate which first allows any fluid, such as water, to evaporate, then allows removal of the flow medium. Next, sintering the remaining reinforcement material and binder to form a solid preform. Then, forcing molten metal under pressure into said preform. Next, solidifying the molten metal to form a metal matrix composite in the shape of this preform; and removing the investment material from metal matrix composite.

Additionally, there is a method comprising the steps of connecting a preform, which has been previously prepared for infiltration of molten metal, to a sprue system. Next, encasing the preform and sprue system within investment material. Then, melting out the sprue system to form piping which allows the metal to flow to the preform. Next, forcing molten metal under pressure through the sprue system and into the preform. Then, solidifying the molten metal to form a metal matrix composite in the shape of the preform; and removing the investment material from metal matrix composite.

BRIEF DESCRIPTION OF THE DRAWINGS

In the accompanying drawings, the preferred embodiments of the invention and preferred methods of practicing the invention are illustrated in which.

DESCRIPTION OF THE PREFERRED EMBODIMENT

Figure 1:
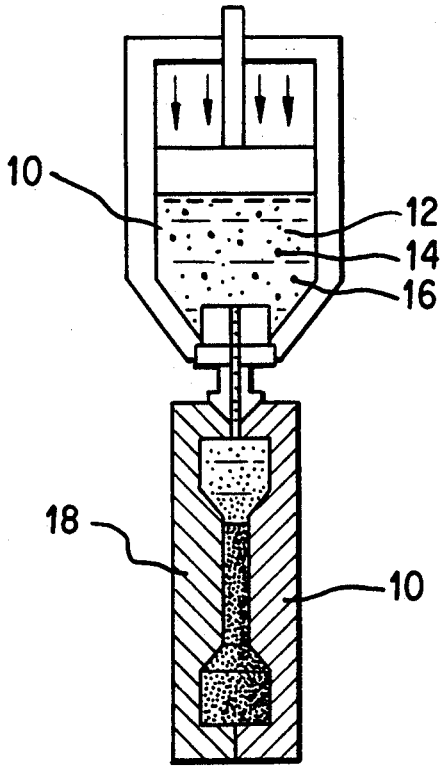
FIG. 1 is a cross-sectional schematic view showing the casting of the preform mixture.

Referring now to the drawings wherein like reference numerals refer to similar or identical parts throughout the several views, and more specifically to FIG. 1 thereof, there is shown a cross sectional schematic view of a preform mixture 10 in a liquid form. The mixture 10 is comprised of a flow medium 12, such as wax or water, discontinuous reinforcement material 14, such as SiC particulate, and reinforcement binder 16, for example, silica (represented in the figures by dots). The preform mixture 10 is forced into a preform mold 18. In another embodiment, continuous reinforcement 20 such as wrapped fiber, such as graphite (represented on the figures by hatching), is placed within the preform mold 18 prior to introduction of the flow medium 12 and reinforcement binder 16.

Figure 2:
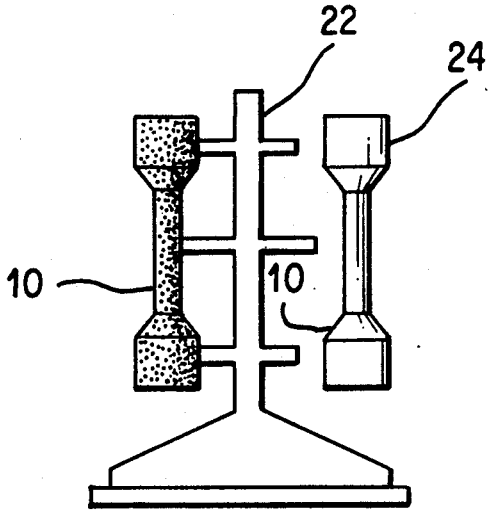
FIG. 2 is a cross-sectional schematic view showing the connection of the cast preform mixtures to the sprue system.

The preform mixture 10 is then solidified and removed from the preform mold 18. As best shown in FIG. 2, a plurality of solidified preform mixture 10 are fixedly attached to a wax or plastic sprue system 22. A single solidified preform mixture 10 can be attached to sprue system 20, but it is typically more economical to cast a plurality of parts through a common sprue system 20. Next, a mold coating 24, such as silicate glass, is applied to the solidified preform mixtures 10 and sprue system by dipping or spraying. This mold coating 24 is comprised of materials which help to form a seal around the solidified preform mixture 10 and aid in removal of the parts from the mold.

Figure 3:
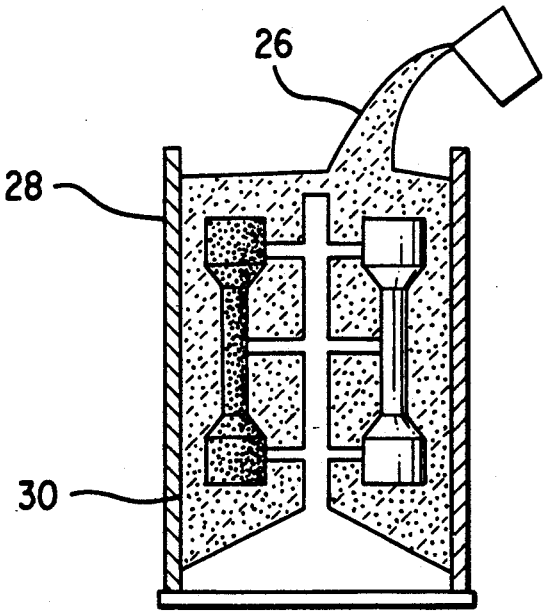
FIG. 3 is a cross-sectional schematic view showing the encasement of the cast preform mixtures within investment material.

FIG. 3 shows the step of encasing the sprue system 22 with attached solidified preform mixtures 10 within investment material 26 which is disposed in a can mold 28 coated with mold release 30. In another preferred embodiment, the sprue system 22 with attached solidified preform mixtures 10 is coated with a slurry of investment material 26 which is comprised of refractory material such as ceramic.

Figure 4:
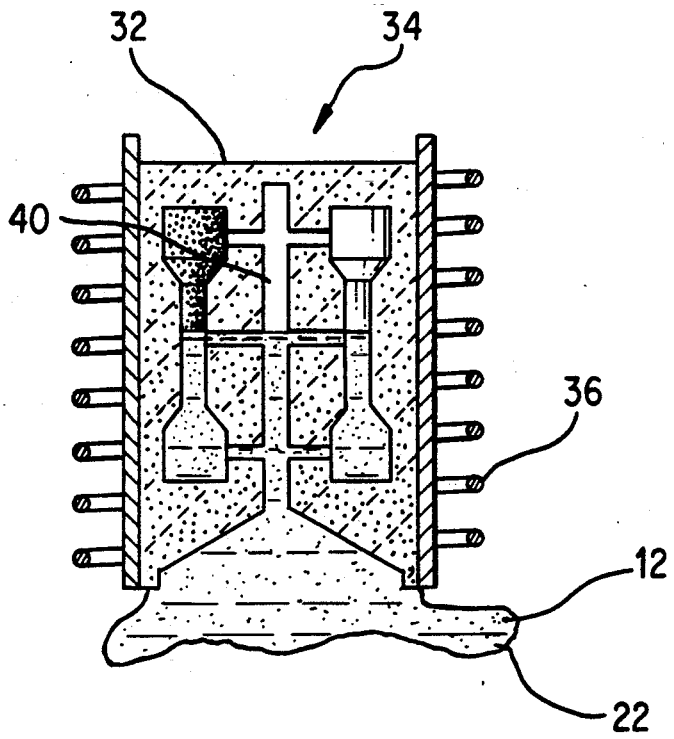
FIG. 4 is a cross-sectional schematic view showing the removal of the flow medium and sprue system material by heating.
Figure 5:
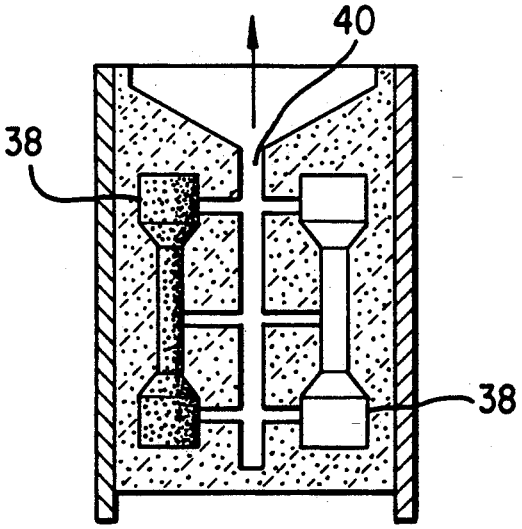
FIG. 5 is a cross-sectional schematic view showing the evacuation of gas from the sprue system and preforms.
Figure 6:
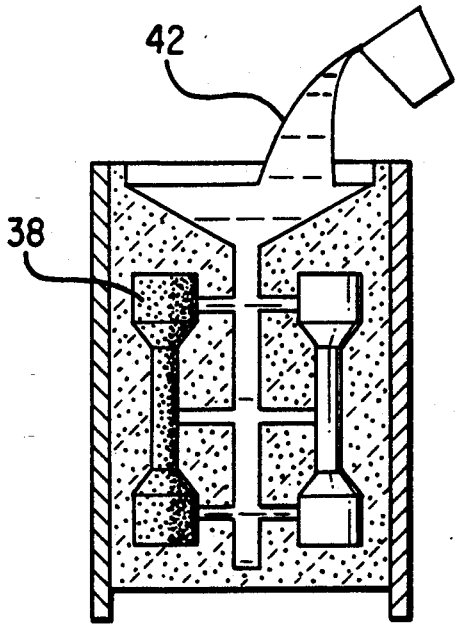
FIG. 6 is a cross-sectional schematic view showing the metal being poured into the sprue system.
Figure 7:
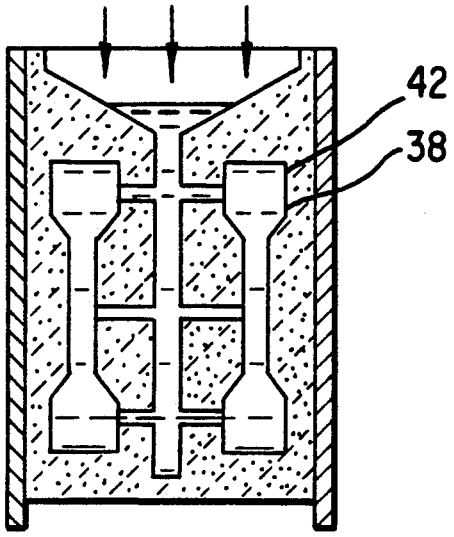
FIG. 7 is a cross-sectional schematic view showing the pressurization step which forces the molten metal into the preforms.
Figure 8:
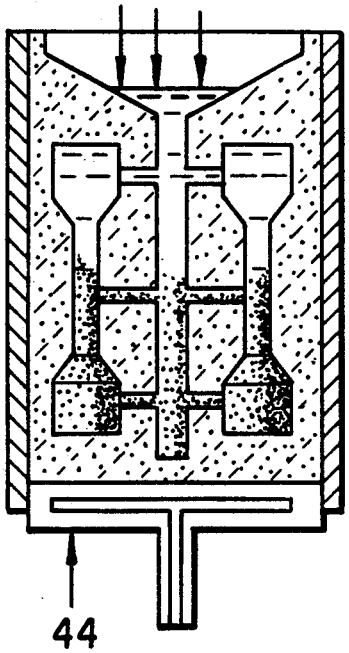
FIG. 8 is a cross-sectional schematic view showing directional solidification of the cast metal matrix composite parts by a chill plate.
Figure 9:
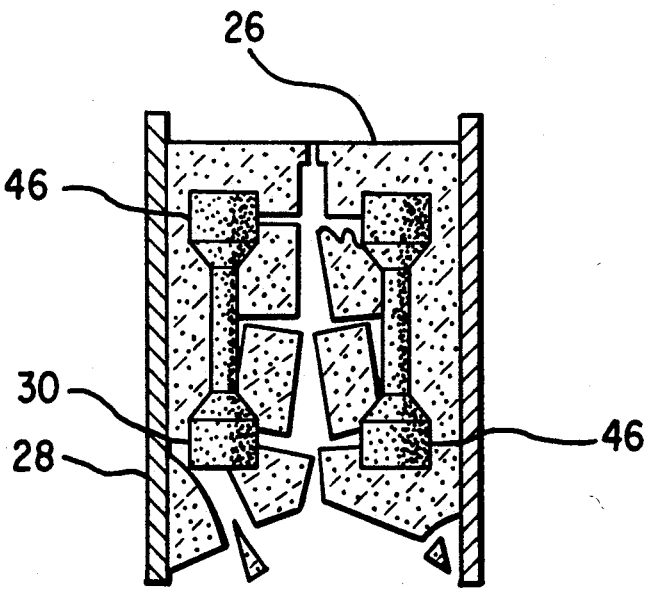
FIG. 9 is a cross-sectional schematic view showing removal of the investment material from the metal matrix composite parts.

Next, as shown in FIG. 4, the mold assembly 34 which is comprised of sprue system 22, solidified preform mixtures 10 and investment material 26 is heated at a controlled rate by heater 36. It is heated such that, first any fluid, for example, water is slowly evaporated from the mold assembly 34, then flow material 12 and the wax or plastic of sprue system 22 is melted out. Finally, the investment material 32, reinforcement binder 16 and discontinuous reinforcement material 14 (or continuous reinforcement material 20) is sintered. This process yields a plurality of preforms 38 connected by the piping 40 left behind by the melted sprue system 22; all encased within investment material 32. As shown in FIG. 5, the preforms 38 and piping 40 are evacuated to remove any gas. Next, as shown in FIG. 6, molten metal 42 is poured or injected into the sprue system 22. The molten metal 42 is then forced by pressure through the piping 40 into the interstices of the preforms 38 as shown in FIG. 7. Coating 24 prevents the metal from infiltrating into the investment 26. A chill plate 44 can then be used to directionally solidify the metal 42, while the pressure is still being applied. This allows for excess molten metal 42 to fill the voids of preforms 38 as the metal 42 solidifies and contracts. The investment material 32 is finally removed from the resulting metal matrix composite parts 46.

Although the invention has been described in detail in the foregoing embodiments for the purpose of illustration, it is to be understood that such detail is solely for that purpose and that variations can be made therein by those skilled in the art without departing from the spirit and scope of the invention except as it may be described by the following claims.

What is claimed is:

1. A method for forming a metal matrix composite within a mold of investment material comprising the steps of:

forming a preform mixture of liquid flow medium, binding agent and reinforcement into the desired shape of said metal matrix composite;

allowing the preform mixture to solidify into said desired shape;

disposing the preform mixture within a container;

encasing said preform mixture within investment material within said container;

heating said preform mixture such that any water evaporates and the flow medium is removed;

sintering the remaining reinforcement material and binder to form a solid preform;

disposing molten metal on top of the investment material within the container such that the molten metal forms a seal with the container;

pressurizing the molten metal such that it is formed into said preform;

solidifying said molten metal to form said metal matrix composite in the shape of said preform; and removing said investment material from the metal matrix composite.

2. A method as described in claim 1 including before the encasing step, the step of attaching a plurality of preform mixtures to a sprue system for the function of casing a plurality of metal matrix composites during the same process.

3. A method as described in claim 1 including before the encasing step, the step of coating said preform mixture with a sealing agent which will prevent infiltration of the investment material with molten metal during the forcing step.

4. A method as described in claim 2 including after the attaching step, the step of coating said sprue system with attached preform mixtures with a sealing agent which will prevent infiltration of the investment material with molten metal during the forcing step.

5. A method for forming a metal matrix composite within a mold of investment material comprising the steps of:

connecting a preform, which was previously prepared for infiltration of molten material and having a binding agent, to a sprue system;

disposing the preform and sprue system within a nonporous container;

encasing said preform and said sprue system within investment material within said container;

melting out said sprue system to form piping which allow metal to flow to said preform;

sintering said preform with said binding agent therein to form a solid preform;

disposing molten metal on top of the investment material within the containers such that the molten metal forms a seal with the container;

pressurizing the molten metal such that it is forced through said piping and into said solid preform;

solidifying said molten metal to form a metal matrix composite in the shape of said solid preform; and removing said investment material from metal matrix composite.

6. A method as described in claim 5 including before the encasing step, the step of attaching a plurality of preforms to a sprue system for the function of casting a plurality of metal matrix composites during the same process.

7. A method as described in claim 5 including before the encasing step, the step of coating said preforms with a sealing agent which will prevent infiltration of the investment material with molten metal during the forcing step.

* * * * *

UNITED STATES PATENT AND TRADEMARK OFFICE

CERTIFICATE OF CORRECTION

PATENT NO. : 5,113,925

DATED : May 19, 1992

INVENTOR(S) : Arnold J. Cook

It is certified that error appears in the above-indentified patent and that said Letters Patent is hereby corrected as shown below:

In the abstract, line 6, after "into" insert -- the -- .

In the abstract, line 13, replace "said" with -- the -- .

In the abstract, line 16, after "from" insert -- the -- .

In the abstract, line 27, after "from" insert -- the -- .

Column 1, line 45, after "into" insert -- the -- .

Column 1, line 68, after "from" insert -- the -- .

Column 2, line 46, delete "20".

Column 2, lines 46 and 47, delete "(represented on the figures by hatching)".

Column 2, line 52, replace "mixture" with -- mixtures -- .

Column 2, line 55, replace "20" with -- 22 -- .

Column 2, line 57, replace "20" with -- 22 -- .

Column 3, line 12, replace "20" with -- 22 -- .

Column 4, line 10, replace "casing" with -- casting -- .

Column 4, line 33, replace "allow" with --

Signed and Sealed this

Nineteenth Day of October, 1993

Bruce Lehman

*Attest:*

BRUCE LEHMAN

*Attesting Officer*

*Commissioner of Patents and Trademarks*